United States Patent [19]

Urby

[11] Patent Number: 5,046,342

[45] Date of Patent: Sep. 10, 1991

[54] CYLINDER LOCK

[75] Inventor: Lars Urby, Eskilstuna, Sweden

[73] Assignee: ASSA AB, Eskilstuna, Sweden

[21] Appl. No.: 566,394

[22] PCT Filed: Mar. 2, 1989

[86] PCT No.: PCT/SE89/00093

§ 371 Date: Aug. 22, 1990

§ 102(e) Date: Aug. 22, 1990

[87] PCT Pub. No.: WO89/08761

PCT Pub. Date: Sep. 21, 1989

[30] Foreign Application Priority Data

Mar. 8, 1988 [SE] Sweden ..... 8800818

[51] Int. Cl.[5] ..... E05B 35/08

[52] U.S. Cl. ..... 70/337

[58] Field of Search ..... 70/360, 361, 382, 387, 70/493, 337

[56] References Cited

U.S. PATENT DOCUMENTS 3,264,852 8/1966 Gysin .

4,099,395 11/1978 Garza ..... 70/360

4,376,381 3/1983 Muus ..... 70/337

FOREIGN PATENT DOCUMENTS 2614645 6/1977 Fed. Rep. of Germany .

8307139 8/1985 Sweden .

*Primary Examiner*—Robert L. Wolfe

*Attorney, Agent, or Firm*—Sughrue, Mion, Zinn Macpeak & Seas

[57] ABSTRACT

A cylinder lock (1) has a standard lock mode (12 o'clock position) and a service lock mode (10 o'clock position). If the lock plug is turned to the service lock mode with the standard key (8) and left in this position, the plug can be rotated with the aid of the service key (9). The service key is latched against withdrawal, when the lock is in its standard mode. The plug can be displaced axially through a distance of about 0.9 mm, after inserting the standard or service key. A latching device (22) prevents axial return movement of the plug when an attempt is made to remove the service key with the lock in its standard lock mode. This can avoid unintentional jamming of the lock in the standard mode.

21 Claims, 5 Drawing Sheets

CYLINDER LOCK

FIELD OF INVENTION

The present invention relates to a cylinder lock of the kind which comprises a plug or cylinder which is mounted for rotation in a cylinder housing and which has a keyway provided therein and a row of pin-channels having pins disposed therein and being intended for coaction with at least two rows of pin-channels disposed in the cylinder housing and having spring-actuated pins located therein, namely a first row of pin-channels which correspond to a standard lock mode in which a standard key can be inserted into the lock and the cylinder or plug turned, and a second row of pin-channels which is inclined to the first row and and which corresponds to a service position, and in which lock one or more of which pin-channels of said row accommodate intermediate pins in addition to upper pins, wherein when the lock is in its service mode, a service key can be inserted into the lock and the plug turned and a standard key can also be inserted into and removed from the plug, but wherein the service key is latched against withdrawal when the lock is in a standard lock mode.

Such locks have the advantage that a person with access to a service key, for example a janitor or like attendant with respect to a block of apartments, can obtain access to an apartment with the aid of the key, but only if the occupier of the apartment so permits. When the occupier of an apartment is willing for the janitor or like person to enter the apartment during his/her absence, he/she turns the lock to the service lock mode when leaving the apartment, so that the janitor can enter with the aid the service key.

When leaving the apartment, however, the janitor cannot turn the plug to its standard mode or position, since he/she will be unable to remove the key from the lock, with the plug in said standard mode.

When the occupier of the apartment leaves the lock in its standard mode, it is not possible to enter the apartment with the aid of the service key. Although it is possible in some instances to insert the key into the keyway, one or more pins in the pin channels will prevent rotation of the lock plug. The plug can be turned, however, irrespective of whether the lock is in its standard mode or its service mode.

BACKGROUND PRIOR ART

SE-B-8307139-9 (GKN-Stenman) describes a lock of this kind in which one of the intermediate pins has a larger diameter than a corresponding upper pin in the first row of pin-channels and a corresponding pin-channel in the plug has a widened part capable of accommodating said intermediate pin of larger diameter. In this case, the intermediate pin can be accommodated in the widened part of the plug pin-channel, but is unable to enter plug pin-channels of smaller diameter, and hence the service key is latched. This solution is simple from the aspect of manufacture and affords several advantages. However, if an attempt is made to remove a service key with the lock in its normal or standard mode, there is a risk that the intermediate pin will wedge between a widened and a narrower channel part, therewith making it impossible to return the plug to the service mode of the lock. This means that the service key cannot be removed under any circumstance and that the lock must be broken into, in order to open the lock.

NO-A-793880 (Elkem-Spigerverket) describes another lock arrangement in which the number of pin-channels in the standard mode of the lock differs from the number of pin channels in the service mode thereof. In this case, withdrawal of the service key when the lock is in its standard mode is prevented, because of the inability of a corresponding lower pin to move upwards in the service mode of the lock. It is comparatively simple, however, to file down the part of the key concerned, so as to negate the intended latching effect.

Lock constructions are also known to the art in which the plug is intended to move axially in relation to the plug housing, when the plug is turned to lock or unlock the lock mechanism. These lock constructions, however, do not have the aforesaid special function which enables the lock to be opened with the aid of a service key. Examples of known lock constructions which incorporate an axially movable plug are found in DE-A-26 14 645. (Sanpo Lock), U.S. Pat. No. 4,099,395 (Garza) and U.S. Pat. No. 3,264,852 (Gysin).

OBJECT OF THE INVENTION

One object of the invention is to provide a cylinder lock of the said kind which avoids the risk of one of the pins in the various pin-channels from fastening or jamming when, for instance an attempt is made, with the lock in its standard mode, to withdraw a service key inserted into the lock in the service mode of said lock.

Another object is to provide a cylinder lock construction which is reliable in operation and resistant to attempts to force the lock, and which will not respond readily to attempts to open the lock with a service key which has been converted, e.g. filed, to a standard key.

SUMMARY OF THE INVENTION

An inventive cylinder lock which fulfills these and other objects is mainly characterized in that subsequent to inserting a standard key into the lock in its standard or service mode, or to inserting a service key with the lock in its service mode, the lock cylinder or plug is movable axially from an initial position (position I) to a displaced position (position II) in which the plug pin-channels are out of register with pin-channels located in the plug housing, such that an intermediate pin, irrespective of the position of said pin in an associated channel belonging to the plug housing or the plug when a key is inserted will remain in said channel, at least until the plug is moved axially to the initial position (position I).

The axial displacement of the plug, which can only be effected in certain positions of plug rotation, ensures that the pin will remain in its adopted position in respective channels until the plug is again moved axially, back to its starting position, which normally occurs when removing the key from the lock.

This eliminates the risk of jamming of a pin. In addition to the aforesaid desired function, the lock is very difficult to force.

The plug may be arranged for axial movement through a distance which is smaller than the diameter of the pin, preferably smaller than the pin radius, and suitably smaller than one third (1/3 rd) of the pin diameter.

The pins of a cylinder lock of the kind to which this document refers will normally have a diameter of about 3 mm. Thus, the extent to which the plug can be moved will suitably be less then 1 mm, preferably about 0.9 mm.

The inventive lock differs in this respect from other types of locks equipped with axially movable cylinder plugs, in which the plugs have a much longer axial travel and in which the function achieved with axial plug displacement is different to that achieved with the inventive lock.

In the case of one preferred embodiment of the invention, a latching device is adapted to prevent the plug from being returned to the said initial position in given rotational positions of the plug. This enables the provision of simple cylinder lock construction which incorporates the desired function.

Preferably the latching means will be constructed such as to prevent any of the pins from becoming wedged or jammed, particularly if a person in possession of a service key should attempt to turn the cylinder plug to its standard lock mode and withdraw the key with the plug in this position. Although it is possible to turn the plug in this position, the plug will not accompany the service key as it is withdrawn, since movement of the plug is prevented by the latching device. This eliminates the risk of a pin jamming in the lock.

In accordance with one further development of the invention, when the lock is in its service mode, the latching device will be returned by the standard key to a release position which will permit the plug to be moved axially to the initial position (position I), optionally after rotating the plug to its standard or normal position.

In the case, the latching device can only be returned to a release position by the standard key. The service key does not have this ability, which in practice means that it is not possible to modify the service key, e.g. by filing, so that it will function as a standard key.

In accordance with one embodiment, the latching device is constructed for actuation by the standard key via an axially movable element, e.g. a pin, in the region of the inner end of the keyway in the plug.

Alternatively, the latching device may be arranged for radial movement and made actuable by the standard key via a pivotal element in the region of the inner end of the keyway in the cylinder plug.

In the first of these cases, the latching device may include an angled arm, and the apex or knee of the angle will then serve as a pivot point for pivotal movement of the arm between the latching and the release positions, one part of said arm being driven by the axially movable element and the other part by the spring.

In the second or alternative case, the latching device includes a pin, plate or some corresponding element which is activated by a peglike part which is provided with a flange against which the standard key bears and which is embraced by a coil spring.

Both of these latching device alternatives, together with associated device activating means, will occupy only a small amount of space in the lock mechanism. Nevertheless, the latching devices operate with great reliability, despite their smallness.

The cylinder plug may also be provided with a snap-in device in the form of a spring-operated peg which engages in a groove or like track extending along a part of the plug periphery, such as to hold the plug in the initial position (position I) in given positions of rotation.

Such an arrangement will ensure that the plug can be moved axially only in certain given instances, e.g. in dependence on the type of key inserted in the lock, or in which mode the plug is positioned, all in accordance with the present invention.

Furthermore, it can be ensured that the plug will not move axially until, for instance, the standard key is inserted in the lock and the cylinder plug turned through a given angle.

The snap-in device will also be capable of ensuring that the cylinder plug will always adopt its initial position, when the standard key or the service key is removed from the lock.

The arrangement may, for instance, also be such that the groove will present its deepest pin-engagement depth in the standard and service lock modes and will shallow up peripherally from these positions, so as to enable the plug to move axially subsequent to rotation, provided that such movement is permitted by the latching device.

Alternatively, the snap-in device may be constructed to be moved to a release position by the spine of the key, when inserting the standard or the service key into the lock, such as to enable the plug to move axially.

The invention will now be described in more detail with reference to exemplifying embodiments thereof illustrated in the accompanying drawings.

BRIEF DESCRIPTION OF THE DRAWINGS

FIGS. 9–12 are part sectional views which illustrate an alternative embodiment of the end of the plug or cylinder, together with associated activators and latching devices, in which;

FIG. 9 shows the plug in its standard position, with no key inserted;

FIG. 10 shows the plug in its service position, with no key inserted;

FIG. 11 shows the plug in its standard position, with a standard key inserted, and FIG. 12 shows the plug in its service position, with a service key inserted.

DESCRIPTION OF PREFERRED EMBODIMENTS

Figure 1:
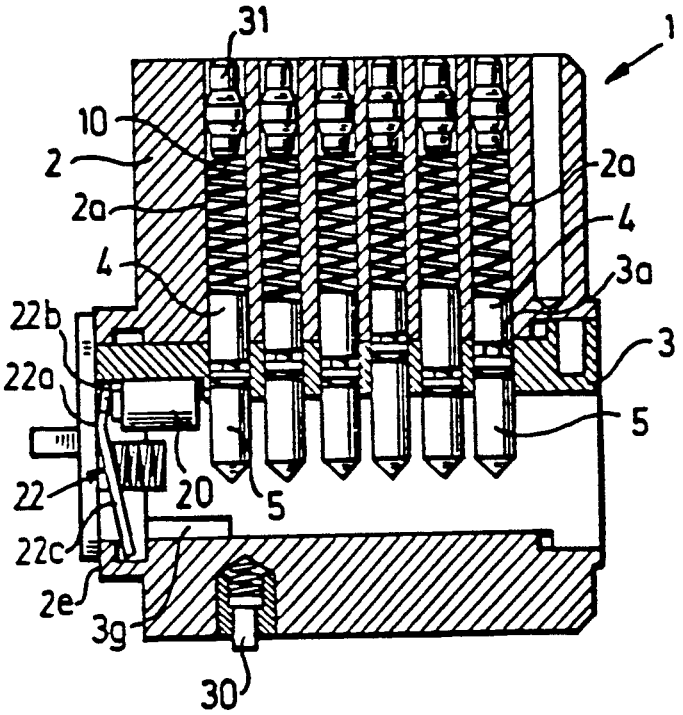
FIG. 1 is a sectional view of an inventive cylinder lock and shows the plug or cylinder in its standard lock position and with the key removed.

With reference primarily to FIGS. 1–4, a cylinder lock 1 comprises a plug housing 2 which has a plug or core 3 mounted for rotation therein. Also mounted in the plug housing are two rows of pin-channels, of which one corresponds to the standard mode of the lock plug (12 o'clock position) and the other corresponds to the service position or mode thereof (10 o'clock position).

The pin-channels corresponding to the standard plug position are referenced 2*a*, as shown in FIG. 1, and accommodate upper pins 4 which are operated by springs 10, as also shown in FIG. 1. The upper pins 4 have a particular configuration, which may vary, so as to make forcing of the lock difficult, and may also have mutually different properties. Some of the pins may be provided with hard cores, to make it difficult to drill out the pins.

The plug 3 has arranged therein a row of pin-channels 3*a* which accommodate lower pins 5, which, similar to the pins 4, may have varying configurations and properties. The plug keyway is reference 3*c*.

Figure 2:
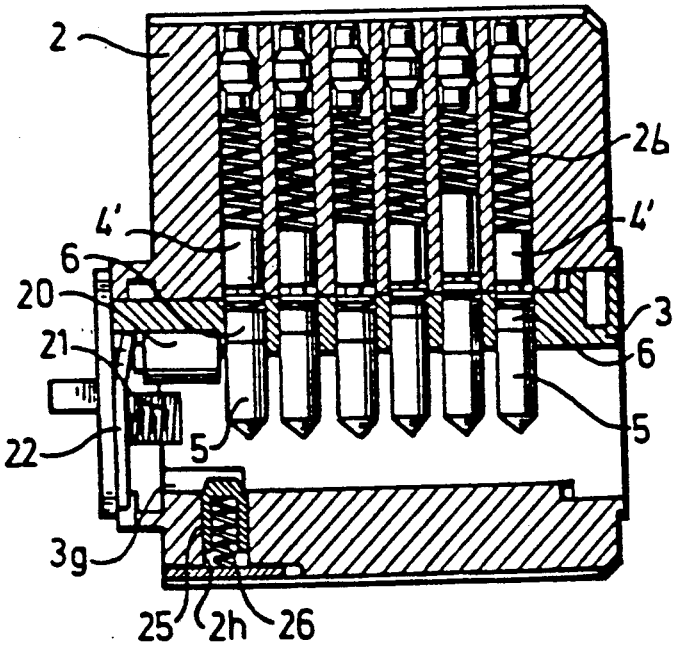
FIG. 2 is a cross-sectional view of the lock of FIG. 1 and shows the lock in its service mode, with the key removed.

As shown in FIG. 2, the plug housing 2 has a second row of pin-channels, referenced 2*b*.

The upper pin-channels 2*a* in the plug housing are stoppered with individual stopper 31, against which the springs 10 rest.

In the standard mode of the lock, (12 o'clock position) the upper pins 4 and the lower pins 5 are housed in their respective channels 2*a* and 3*a* in the plug housing 2 and the plug 3. In the service mode of the lock, (10 o'clock position), the pin-channels 2*b* present upper pins 4' and intermediate pins 6, these latter pins having entered the pin-channels 3*a* in the plug 3, where they lie against the under pins 5.

When no key is inserted into the plug, the plug is latched against rotation by the pins, in both the standard and service position of the plug.

As will be described in more detail here below, the plug 3, when occupying one of a number of given positions, can be displaced axially over a short distance when a key is inserted. This distance is preferably smaller than one third of the diameter of the pins, in practice about 0.9 mm, and certain members co-act to allow and to prevent axial movement of the plug.

These members include an axially movable operating pin 20, a latching arm 22 which is activated by a spring 21, and a recess 2*g* in a housing part 2*e* which projects out from the housing and surrounds the lock plug 3 when the plug is in its service position.

The latching arm 22 is an angled arm and has two parts 22*b* and 22*c* located on a respective side of an angle bend 22*a*, said angle bend functioning as a pivot point for pivotal movement of the arm between the latching and the release position. The arm part 22*b* is activated by the axially movable operating pin 20, whereas the arm part 22*c* is activated by the spring 21.

Figure 4:
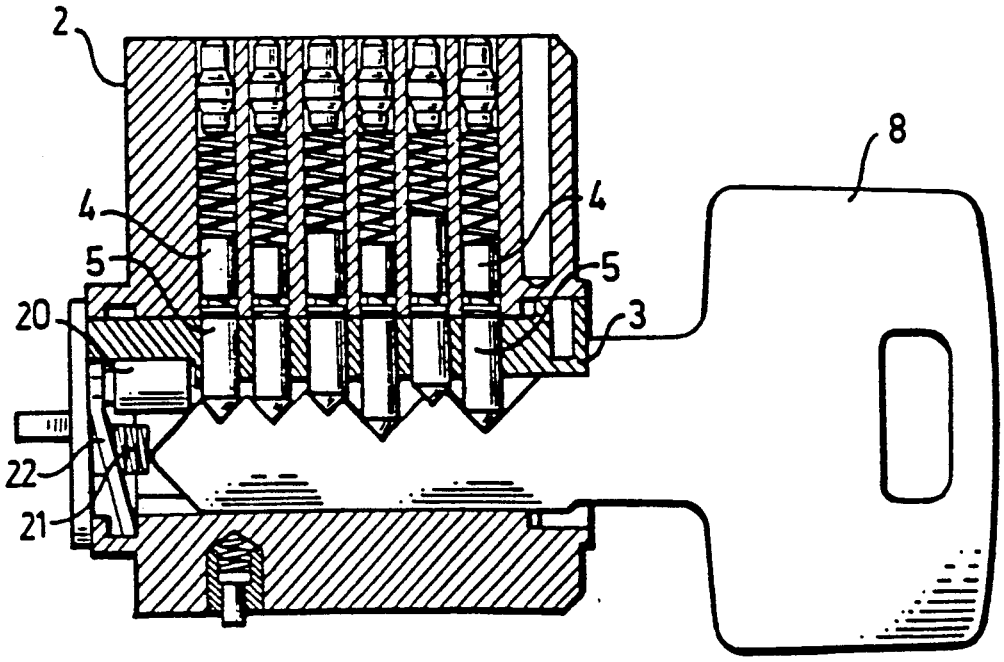
FIG. 4 is a vertical sectional view of the cylinder lock with a standard key inserted in the standard lock mode, and illustrates the initial axial position of the lock (position I), i.e. the state of the lock prior to axial displacement of the lock plug.

FIG. 4 shows the plug 3 in its standard or normal position, with a standard key 8 inserted in the keyway 3*c*.

The division plane between the upper pins 4 and the lower pins 5 coincides with the peripheral surface of the plug 3, which thus means that the plug can be turned and that the key 8 can also be withdrawn from the lock in a normal fashion.

The plug 3 is also able to move axially forwards through the aforesaid distance, i.e. about 0.9 mm, to the position II.

The latching arm 22 will therewith be rotated slightly in an anti-clockwise direction, about its pivot point 22*a*.

Figure 5:
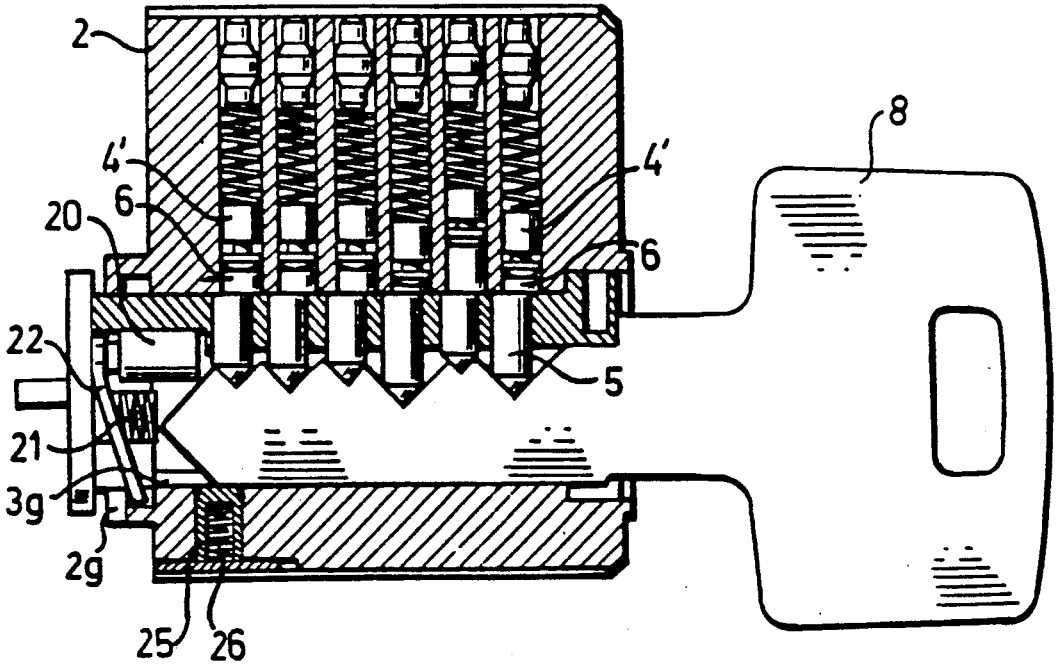
FIG. 5 illustrates the lock of FIG. 4 with a standard key inserted and subsequent to axial displacement of the plug and rotation of the plug to the service mode.

Subsequent to being displaced axially, the plug can be turned with the key 8, either to open the lock or to move the plug to its service position, illustrated in FIG. 5.

In this position of the lock, the plug can be returned axially to the right, i.e. to the initial position (position I) as the key 8 is removed. The lower end of the latching arm 22 will then be swung clockwise by the spring 21, out of engagement with the recess or notch 2*g*, since there is no obstruction in the path of said arm.

The lock will take the position or mode illustrated in FIG. 2, when the standard key 8 is withdrawn from the lock.

Figure 6:
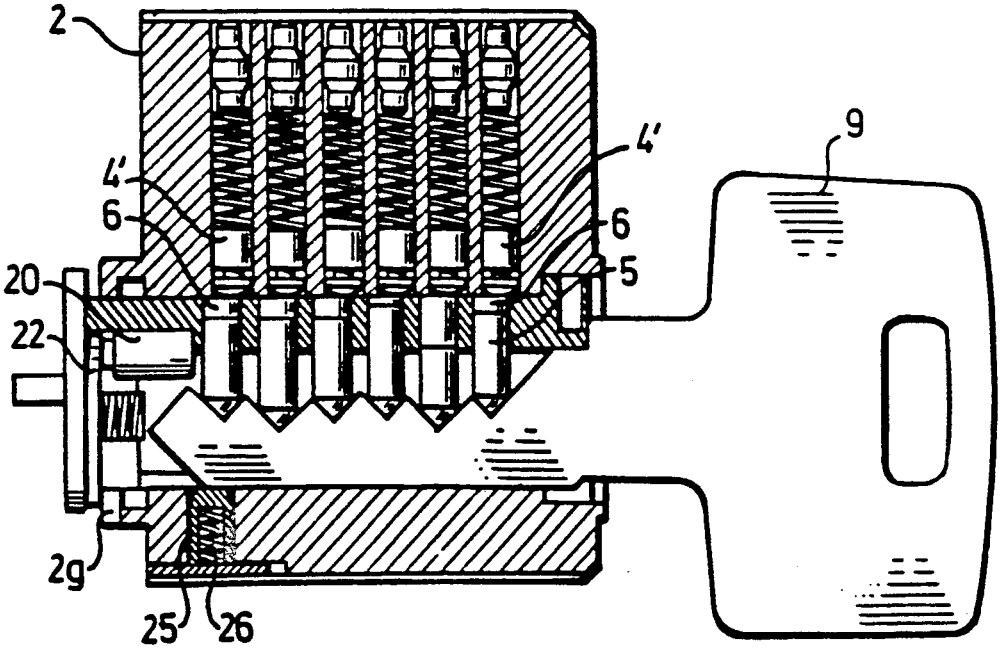
FIG. 6 is a cross-sectional view of the lock in its service mode, subsequent to insertion of the service key and axial displacement of the cylinder plug to position II.

If a person who possesses a service key 9, now wishes to open the lock, he inserts the key and therewith moves the plug axially forwards to the position of displacement shown in FIG. 6 (position II). The plug can be rotated from this position through one revolution, such as to enable the lock to be opened. When the key 9 is subsequently removed, the plug 3 is first displaced axially to the right (position I), whereafter the key is withdrawn in the normal fashion and the lock will again take the position illustrated in FIG. 2.

Figure 7:
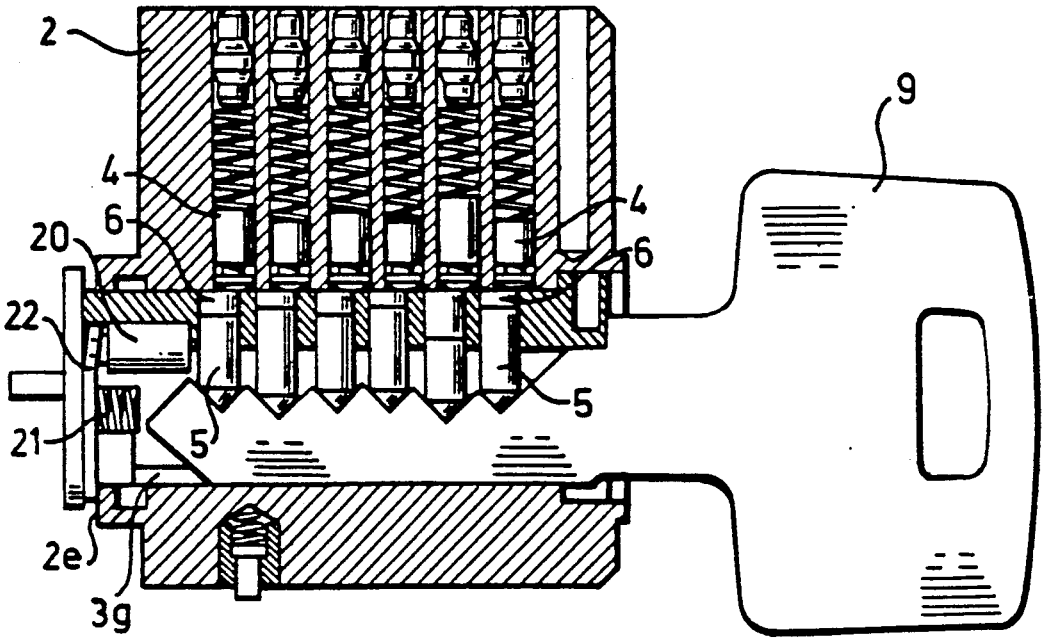
FIG. 7 is a cross-sectional view of the lock according to FIG. 6, with the service key inserted and subsequent to turning the plug to its standard lock mode.

If, on the other hand, the plug is turned to the standard position or mode illustrated in FIG. 7, by means of the service key 9, in which the plug 3 is located in the position of displacement to the left (position II), it is not possible for the plug to return to the initial position (position I), since the latching arm 22 lies against the outer peripheral part 2*e* of the plug housing 2. Furthermore, it is impossible to remove the service key 9 from the lock, unless the plug 3 can be moved to the right.

At the same time, the upper pins of the cylinder lock 4 are prevented from registering with the pin-channels in the plug and thus from entering said channels. The latching arm 22 performs a double function of preventing the lock from returning to a standard mode.

Figure 8:
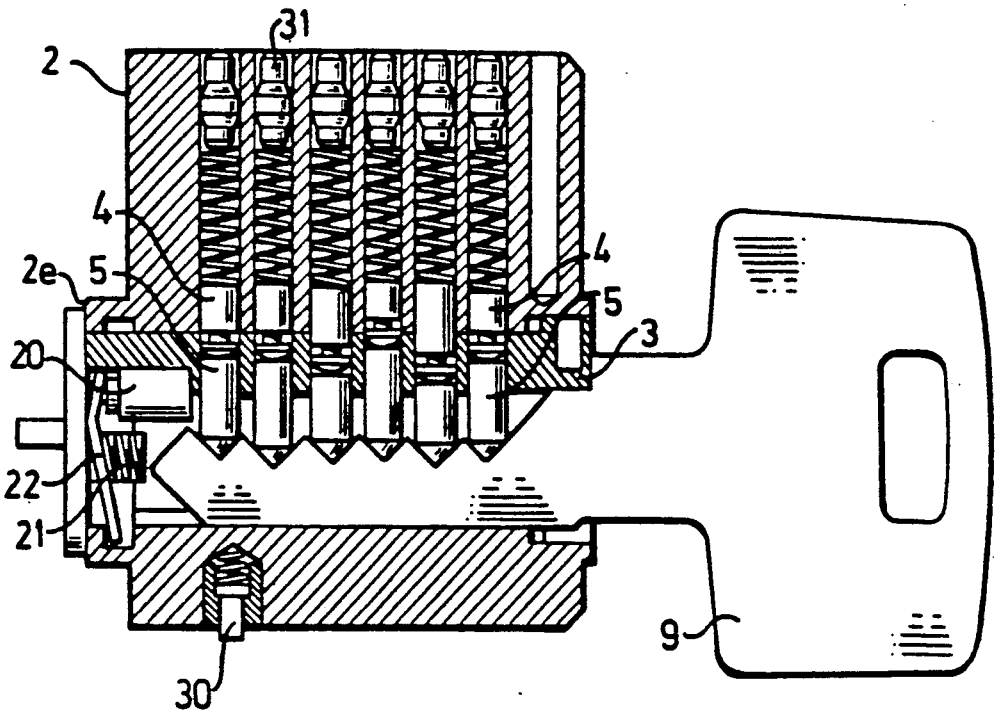
FIG. 8 is a cross-sectional view of the lock according to the aforegoing Figures, with the lock in its standard mode and a service key inserted, both axial displacement and rotation of the plug being prevented.

FIG. 8 illustrates the case when the lock plug is located in its normal position or standard mode and when a person who has solely a service key 9 in his possession attempts to open the lock. It will be impossible to open the lock in this case, since the pin-channels 2*a*, 3*a* concerned have no intermediate pins (which are only present in the service position) and the upper pins 4 prevent both rotation and axial displacement of the plug 3.

In the service mode of the lock, illustrated in FIGS. 2, 5 and 6, there is found a snap-in member 25 in the form of a peg or stud which is activated by a spring 26 and which is intended to engage in a groove 3*g* which extends along part of the peripheral service of the plug so as to hold the plug in its initial position (position I) in given positions of plug rotation. The snap-in member will therewith prevent displacement of the plug to position II. When a standard or service key is inserted into the lock, the spine of the key will displace the snap-in member to its release position, illustrated in FIG. 5 and 6.

FIGS. 9–12 illustrate schematically an alternative embodiment which differs from the aforedescribed embodiment, interalia with respect to the configuration of the latching device.

In embodiment illustrated in FIGS. 9–12, like elements have been identified with like references used in the earlier Figures, although accompanied with a prime sign (').

Figure 9:
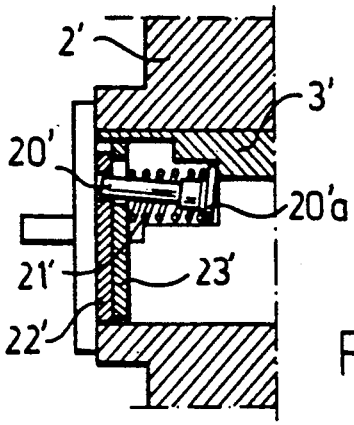

FIG. 9 illustrates the end of the lock housing 2' with the lock plug 3', which is located in its standard lock mode. In this embodiment, the latching device 22' comprises a radially moveable pin or plate, which is activated by a peg-like part 20', one end of which engages in a hole in the pin 22'. The opposite end of the peg-like part has provided thereon a flange 20'a and is surrounded by a coil or pressure spring 21'.

The peg-like part 20' is accommodated in a recess or indent in the plug 3', more specifically in a manner which will enable the peg-like part to pivot about a peripheral part of the flange 20'a. Pivotal movement of the peg-like part is guided by a guide plate 23', which is provided an oval hole 23'a. The peg-like part extends through the oval hole 23'a and, when the standard key 8 is inserted, will execute pivotal movements which are transmitted to the latching device 22', causing said device to move between a latching position, illustrated in FIG. 10 and FIG. 12, and a release position, illustrated in FIGS. 9 and 11.

Figure 10:
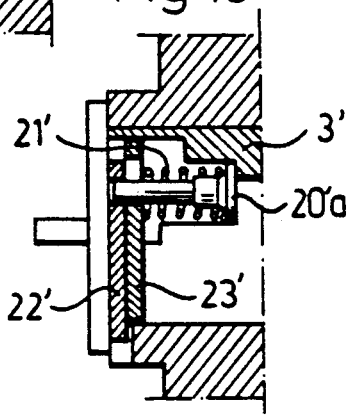

FIG. 9 shows the plug in its standard mode, whereas FIG. 10 shows the plug in its service mode position with no key inserted.

Figure 11:
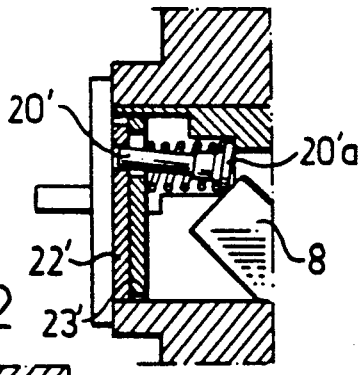
Figure 12:
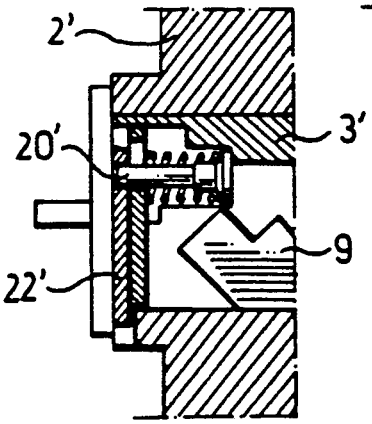

FIG. 11 shows the plug in its standard mode with a standard key 8 inserted, whereas FIG. 12 shows the plug 3' in its service mode with a service key 9 inserted.

As with the embodiment earlier described, the standard key 8 will activate the operating device and (compare FIG. 11) the peg-like part will be swung upwards by contact with the key with the flange 20'a on the peg-like part 20'. This will ensure that the latching device 22' will adopt its release position even after rotation of the plug until the standard key is removed.

The peg-like part 20' will therewith pivot to bring the latching device 22' to the latching position illustrated in FIG. 10 or FIG. 12.

The peg-like part will not be activated if the service key 9 is inserted into the lock with the lock in any one of these positions, and consequently the latching device 22' will remain in its latching position.

However, similarly to the aforedescribed embodiment, the plug can be rotated by the service key, although the plug cannot be displaced axially in the standard mode of the lock, since the latching device 22' will prevent axial movement owing to its engagement with a recess 2'g in the plug housing 2'.

A comparison between FIG. 9 and FIG. 1, FIG. 10 and FIG. 2, FIG. 11 and FIG. 4, and FIG. 12 and FIG. 6 will show that the plug of the embodiment according to FIGS. 9–12 lacks a groove of the kind referenced 3g in the embodiments according to FIGS. 1–8, and also lacks the snap-in member 25 which engages the groove in said service position in accordance with said Figures.

The absence of this groove and snap-in member is not meant to imply that said groove or member need be omitted from the embodiments according to FIGS. 9–12. However the groove—which is not shown in any of the FIGS. 9–12—has a different extension and configuration than the extension and configuration earlier described.

In the case of the embodiment illustrated in FIGS. 9–12, the cylinder lock is constructed so that the plug cannot be moved axially from position I to position II until a key has been inserted and the plug turned from its standard lock mode position, i.e. solely with the aid of the standard key.

More specifically, the groove (not shown in FIG. 9–12) has its fullest depth for engagement of a pin (not shown) in the standard and optionally also in the service position, said groove shallowing up peripherally. The pin 26 may be located somewhere between the standard and the service plug position, and the groove will preferably shallow in the aforedescribed manner, peripherally in both directions.

Consequently, in the case of this embodiment a snap-in member will not be activated when a key is inserted in the standard lock mode, and consequently, the plug will not be capable of moving axially immediately upon insertion of the key.

Instead, is necessary to rotate the plug through a given angle, for instance 10°, whereafter the snap-in member or pin, as result of the shallowing of the groove, will move to its release position and therewith enable the plug to move axially, in accordance with the invention.

When the service key is inserted into the lock in its service mode, in which the latching device 22' is located in its latching position, the snap-in member is not activated in the manner illustrated in FIG. 6 of the earlier embodiment. Instead, it is necessary to turn the plug in order to enable the snap-in member to be moved to its release position.

If, however, the plug is rotated to its standard position, the plug is unable to return axially to position I, since such movement is prevented by the latching device 22'.

It will be understood that coaction of a latching device and snap-in member of the aforedescribed kind enables a combination of movements of the plug to be permitted or prevented, wherewith a movement combination can be selected which, in each case, will provide the most suitable lock embodiment.

Figure 3:
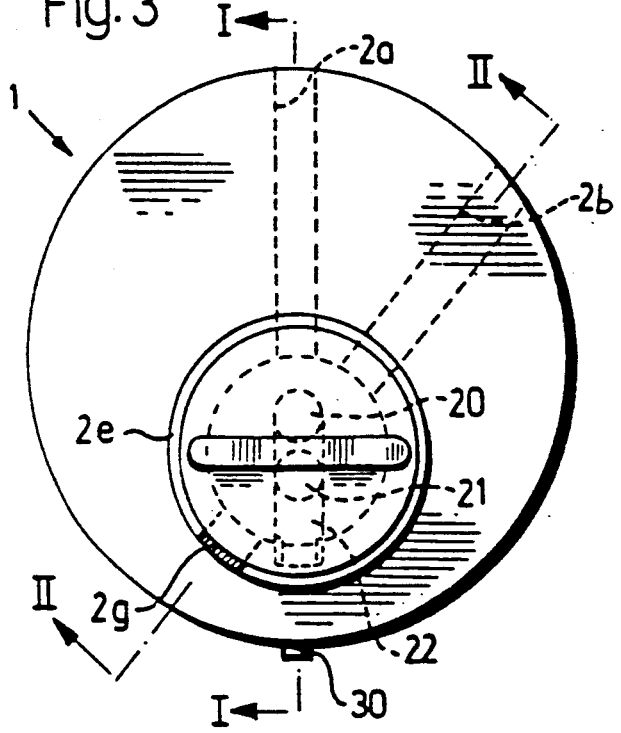
FIG. 3 is an end view of the cylinder lock according to FIGS. 1 and 2, and shows the sectioning lines of FIG. 1 and FIG. 2 respectively.

Furthermore, for the purpose of releasably fixing the cylinder lock, all embodiments may be provided in a known manner, with a snap-in member 30 activated by a spring 29, as illustrated, interalia, in FIG. 1, 3 and 8.

In the case of the illustrated embodiments, the plug can be displaced forwardly in the insertion direction of the key, upon inserting the key. It is possible, however, to give the latching devices a different configuration and/or a different location, such as to enable the plug to be displaced in the other direction, i.e. in a direction opposite to the key insertion direction. For example, the latching devices may, instead, be located in the region of the key insertion end of the plug and arranged to be activated by the key at the region where the key blade merges with the stem or gripping part of the key.

I claim:

1. A cylinder lock provided with a plug or cylinder (3) which is mounted for rotation in a plug housing (2) and which is provided with a keyway (3c) and a row of pin-channels (3a) accommodating pins (5) for co-action with at least two rows of pin-channels (2a; 2b) which accommodate spring-biased pins (4; 4', 6) in the plug housing (2), namely a first row of pin-channels (2a) corresponding to a standard plug mode position, in which a standard key (8) can be inserted and the plug (3) turned, and a second row of pin-channels (2b) located at an angle to the first row and corresponding to a service plug mode, one or more of which pin-channels (2b) in said second row accommodating intermediate pins (6) in addition to upper pins (4'), characterized in that the plug (3) is so arranged as to be movable axially through a distance which is smaller than a pin radius from an initial position (I) to a position of displacement (II) subsequent to insertion of a standard key (8) with the lock in its standard mode or subsequent to inserting a service key (9) with the lock in its service mode, the pin-channels (3*a*) of the plug (3) in the last mentioned position of plug displacement (II) being out of register with pin-channels (2*a*, 2*b*) located in the plug housing, so that an intermediate pin (6), irrespective of the position of said intermediate pin in a channel (2*a*, 2*b*) belonging to the plug housing (2) or the plug (3), subsequent to the insertion of a key, will remain in said channel, at least until the plug is moved axially to the initial position (I).

2. A cylinder lock according to claim 1, characterized in that a latching device (22; 22') is provided for preventing axial movement of the plug (3) to the initial position (I) in certain rotational positions of said plug.

3. A cylinder lock according to claim 2, characterized in that the latching device (22; 22') is effective in preventing the plug (3) from moving axially to the initial position (position I) when the plug is turned from its service mode to its standard mode with the aid of the service key (9).

4. A cylinder lock according to claim 3, characterized in that the latching device (22) in the service mode is intended to be returned by the standard key to a release position which, optionally after rotation of the plug, will permit the plug to move axially back to the initial position.

5. A cylinder lock according to claim 4, characterized in that the latching device is intended for activation by the standard key (8) via an axially moveable element, e.g. a pin (20), in the region of the inner end of the keyway (3*c*) of the plug (3).

6. A cylinder lock according to claim 4, characterized in that the latching device (22') is moveable radially and is actuable by a standard key (8) via a pivotal element (20') in the region of the inner end of the keyway of the plug (3').

7. A cylinder lock according to claim 5, characterized in that the latching device includes an angled arm (22'), of which the angle bend (22*a*) functions as a pivot point for pivotal movement of the arm between the latching position and the release position, and one arm part (22*b*) of which is activated by the axially moveable member (20) and the other arm part is activated by the spring (21).

8. A cylinder lock according to claim 6, characterized in that the latching device includes a pin, a plate (22') or the like which is activated by a flanged peg-like part (20') which is surrounded by a spring (21'), wherein the standard key engages said flange (20*a*).

9. A cylinder lock according to any one of claims 1–8, characterized in that a snap-in member mounted in the plug housing (2) and having the form of a spring-operated pin (25) is intended to engage in a groove (3*g*) which extends along part of the peripheral surface of the lock plug.

10. A cylinder lock according to claim 9, characterized in that the lock plug (3;3') can not be displaced axially to its position of displacement (II) until a key has been inserted into the lock or the plug has been turned from its standard or service position respectively.

11. A cylinder lock according to claim 10, characterized in that the groove (3*g*) has its fullest depth for engagement of the pin (25) in the standard and/or service modes of the lock and shallows up peripherally therefrom, such as to permit the plug to move axially subsequent to rotation, unless prevented by the latching device (22;22').

12. A cylinder lock provided with a plug or cylinder (3) which is mounted for rotation in a plug housing (2) and which is provided with a keyway (3*c*) and a row of pin-channels (3*a*) accommodating pins (5) for co-action with at least two rows of pin-channels (2*a*; 2*b*) which accommodate spring-biased pins (4; 4', 6) in the plug housing (2), namely a first row of pin-channels (2*a*) corresponding to a standard plug mode position, in which a standard key (8) can be inserted and the plug (3) turned, and a second row of pin-channels (2*b*) located at an angle to the first row and corresponding to a service plug mode, one or more of which pin-channels (2*b*) in said second row accommodating intermediate pins (6) in addition to upper pins (4'), characterized in that the plug (3) is so arranged as to be movable axially from an initial position (I) to a position of displacement (II) subsequent to insertion of a standard key (8) with the lock in its standard mode or subsequent to inserting a service key (9) with the lock in its service mode, the pin-channels (3*a*) of the plug (3) in the last mentioned position of plug displacement (II) being out of register with pin-channels (2*a*, 2*b*) located in the plug housing, so that an intermediate pin (6), irrespective of the position of said intermediate pin in a channel (2*a*, 2*b*) belonging to the plug housing (2) or the plug (3), subsequent to the insertion of a key, will remain in said channel, at least until the plug is moved axially to the initial position (I), further comprising a latching device (22; 22') for preventing axial movement of the plug (3) to the initial position (I) in certain rotational positions of said plug.

13. A cylinder lock according to claim 12, characterized in that the latching device (22; 22') is effective in preventing the plug (3) from moving axially to the initial position (position I) when the plug is turned from its service mode to its standard mode with the aid of the service key (9).

14. A cylinder lock according to claim 13, characterized in that the latching device (22) in the service mode is intended to be returned by the standard key to a release position which, optionally after rotation of the plug, will permit the plug to move axially back to the initial position.

15. A cylinder lock according to claim 14, characterized in that the latching device is intended for activation by the standard key (8) via an axially moveable element, in the form of a pin (20), in the region of the inner end of the keyway (3*c*) of the plug (3).

16. A cylinder lock according to claim 14, characterized in that the latching device (22') is moveable radially and is actuable by a standard key (8) via a pivotal element (20') in the region of the inner end of the keyway of the plug (3').

17. A cylinder lock according to claim 15, characterized in that the latching device includes an angled arm (22'), of which the angle bend (22*a*) functions as a pivot point for pivotal movement of the arm between the latching position and the release position, and one arm part (22*b*) of which is activated by the axially moveable member (20) and the other arm part is activated by the spring (21).

18. A cylinder lock according to claim 16, characterized in that the latching device includes a pin, a plate (22') or the like which is activated by a flanged peg-like part (20') which is surrounded by a spring (21'), wherein the standard key engages said flange (20'*a*).

19. A cylinder lock according to claim 12, characterized in that a snap-in member mounted in the plug housing (2) and having the form of a spring-operated pin (25) is intended to engage in a groove (3*g*) which extends along part of the peripheral surface of the lock plug.

20. A cylinder lock according to claim 12, characterized in that the lock plug (3; 3′) cannot be displaced axially to its position of displacement (II) until a key has been inserted into the lock or the plug has been turned form its standard or service position respectively.

21. A cylinder lock according to claim 20, characterized in that the groove (3*g*) has its fullest depth for engagement of the pin (25) in the standard and/or service modes of the lock and shallows up peripherally therefrom, such as to permit the plug to move axially subsequent to rotation, unless prevented by the latching device (22; 22′).

* * * * *